US005311892A

United States Patent [19]

Adelt et al.

[11] Patent Number: 5,311,892

[45] Date of Patent: May 17, 1994

[54] APPARATUS FOR DISPENSING CLEANING FLUIDS TO AN OBJECT

[75] Inventors: Heinz E. Adelt; Robert E. Weeks, both of Racine, Wis.

[73] Assignee: Cyclotron, Inc., Racine, Wis.

[21] Appl. No.: 984,973

[22] Filed: Dec. 3, 1992

[51] Int. Cl.[5] ..... B08B 3/04

[52] U.S. Cl. ..... 134/58 R; 134/95.1; 134/98.1; 134/102.2

[58] Field of Search ..... 134/58 R, 57 R, 56 R, 134/95.1, 98.1, 102.2

[56] References Cited

U.S. PATENT DOCUMENTS

| | | | |
|---|---|---|---|
| 2,471,506 | 5/1949 | Wiswall | 134/98.1 |
| 2,558,628 | 6/1951 | Redin | 134/98.1 |
| 3,453,834 | 4/1969 | Cooper | 134/98.1 |
| 3,941,537 | 3/1976 | Abraham . | |
| 4,109,703 | 8/1978 | Babish et al. | 13/98.1 |
| 4,141,312 | 2/1979 | Louder et al. | 134/95.1 |
| 4,430,129 | 2/1984 | Gamer . | |
| 4,721,532 | 1/1988 | Kuhn et al. . | |
| 4,789,406 | 12/1988 | Holder et al. . | |
| 4,917,123 | 4/1990 | McConnell et al. | 134/98.1 |
| 4,991,608 | 2/1991 | Schweiger | 134/95.1 |
| 5,039,349 | 8/1991 | Schoeppel | 134/95.1 |
| 5,063,242 | 11/1991 | Yates | 134/98.1 |

*Primary Examiner*—Frankie L. Stinson

*Attorney, Agent, or Firm*—Arthur J. Hansmann

[57] ABSTRACT

Apparatus for cleaning an object and presenting several fluids to the object for the cleaning. The apparatus has controls for sequentially and separately presenting the fluids to the object and keeping at least some of the fluids separated from each other.

17 Claims, 2 Drawing Sheets

APPARATUS FOR DISPENSING CLEANING FLUIDS TO AN OBJECT

This invention relates to apparatus for applying fluids to an object for cleaning, and, more particularly, the apparatus functions to sequentially apply several fluids to the object.

BACKGROUND OF THE INVENTION

The invention can be applied to the cleaning of a variety of objects, but it is particularly applicable in cleaning the cooling passageways of an industrial mold. In that context, the cleaning fluids are applied to the mold passageways in a sequential manner such that initially a cleaning acid, such as hydrochloric acid, is applied to the passageways, and then air can be applied to clean out the apparatus lines and the mold passageways, and finally water can be applied to further clean out the lines and passageways. Throughout, the cleaning acid is completely contained in an enclosed system, and it is separated from the other fluids employed. Further, the apparatus is arranged so that it is foolproof from the standpoint of operator's attention, and thus the operator cannot utilize the apparatus to perform certain functions unless and until the apparatus is ready to perform those functions, such as by having performed the necessary previous functions, all to insure that the fluids are properly contained, segregated, and applied in the desired sequence. For instance, the apparatus employs electric controls wherein there are switches for electrically connecting certain valves and fluid pumps, and the operator cannot make the electric connections to those valves and pumps until the automatic sequencing of the apparatus has occurred.

Therefore, the apparatus of this invention is provided to effect a mistake-proof operational apparatus and requiring that the operator perform only a minimal number of manual activities of operating electric switches, and the fluids are sequentially applied to the object to be cleaned and the fluids are retained separated from each other throughout the cleaning procedure and they are in their separate containers.

Other objects and advantages of this invention are to provide apparatus for cleaning objects, and wherein the apparatus can be portable and moved to the location of the object itself, and more than one object can be cleaned at a time, and a timer can be utilized for determining the length of application of the acid cleaner, and the apparatus can be readily connected to the object by means of quick connect and disconnect fluid lines.

Accordingly, the apparatus of this invention is foolproof in operation, easy to operate, safe to operate, is contained in one portable support so that it can be moved from location to location, and it is easily connected to the object to be cleaned, and more than one object can be cleaned at any one time and this is accomplished by means of a plurality of cleaning lines extending in the apparatus and to the object.

DETAILED DESCRIPTION OF THE PREFERRED EMBODIMENT

Figure 2:
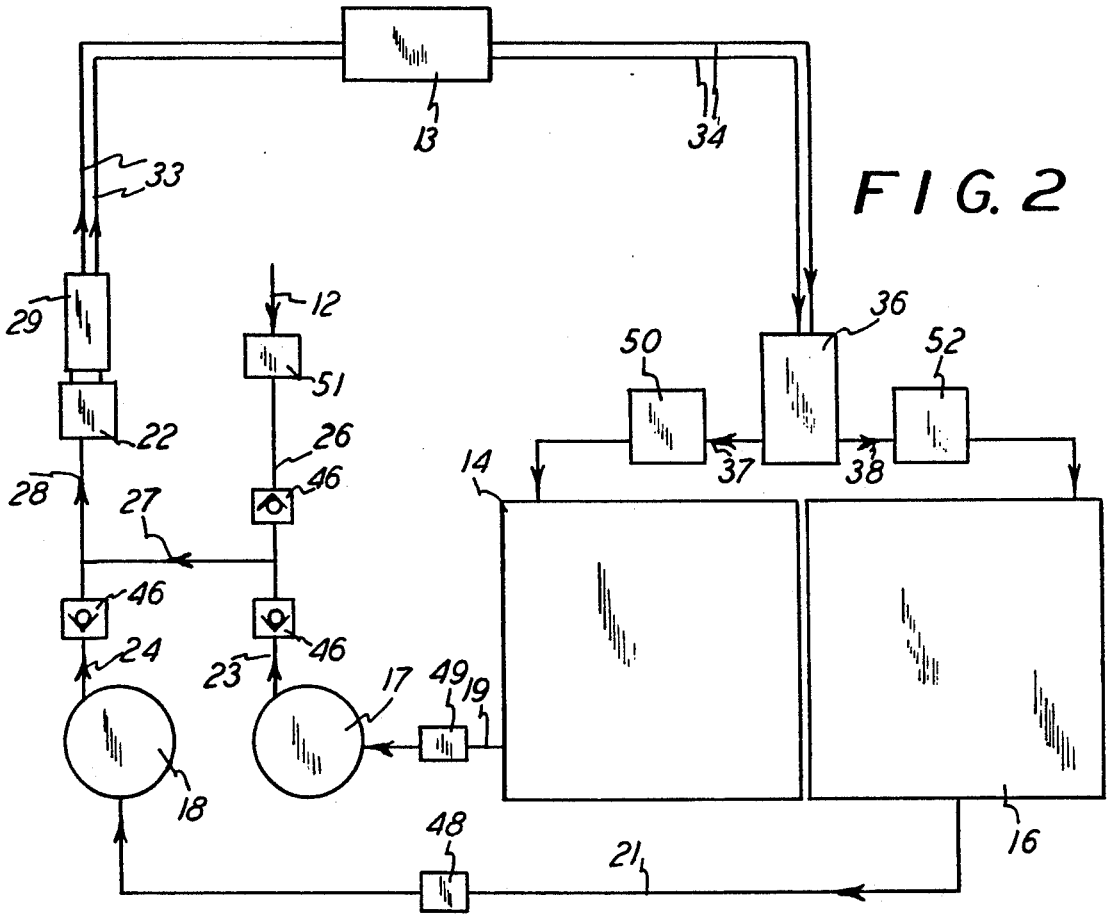
FIG. 2 is a diagrammatic view of the fluid system of this invention.
Figure 1:
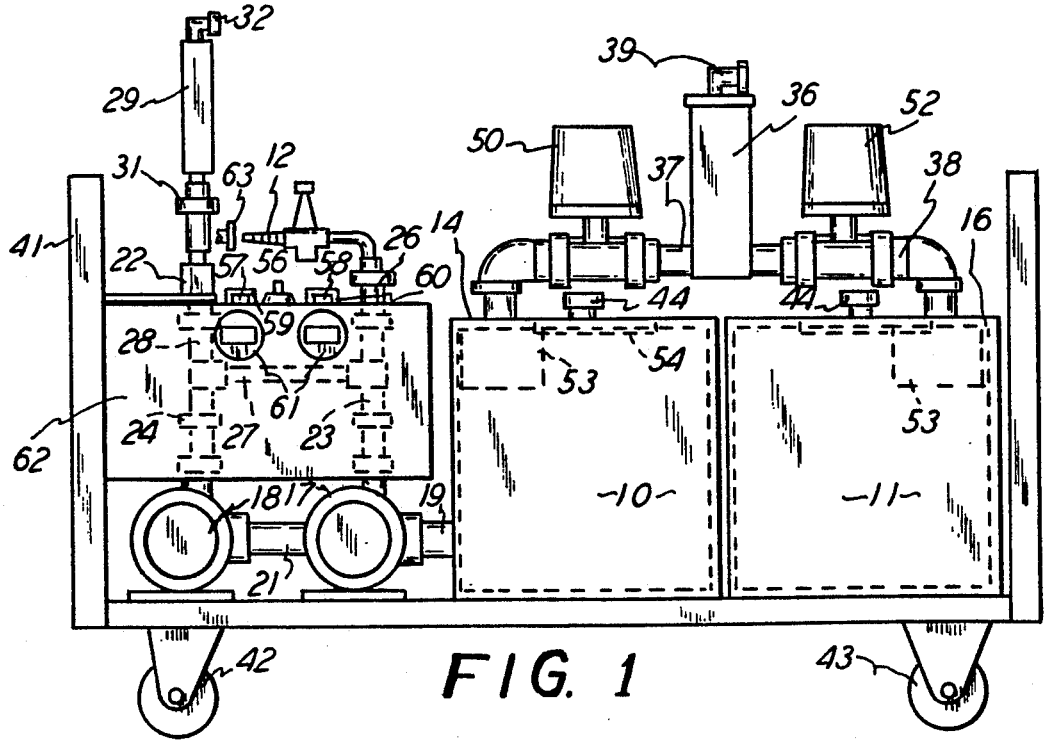
FIG. 1 is a front elevational view of the apparatus of this invention.

FIG. 1 shows the apparatus of an acid supply 10, a water supply 11 and an air inlet supply 12, and these three fluids are utilized in this apparatus and for the cleaning of an object, such as the industrial mold designated 13 in FIG. 2. This is a conventional type of mold which may be utilized for casting of aluminum, and it will be understood that it has a casting cavity and cooling passageways extending therein, but unshown herein. The cleaning or acid supply 10 and the water supply 11 are contained in respective tanks 14 and 16 which are in respective fluid flow communication with fluid pumps 17 and 18 through fluid connecting lines 19 and 21, respectively.

A fluid-containing manifold 22 is in fluid-flow communication with fluid lines 23, 24, and 26, which respectively contain the acid, water, and air for directing the fluid through a line 27 and a line 28 and into the manifold 22. A fluid flow meter 29 is in fluid-flow communication with the manifold 22, such as through the valve 31, and there is a quick connect and disconnect connection 32 in fluid-flow communication with the meter 29 for connecting the fluid lines, such as the lines 33 in FIG. 2, to the mold or object 13. Also, FIG. 2 shows fluid control lines 34 which connect with the mold 13 and with a manifold 36 which receives the fluids and which directs the fluids back into the respective tanks 14 and 16 through the respective fluid flow connections 37 and 38. Again, there is a quick connect and disconnect connection 39 to which the lines 34 are connected for directing the fluid into the manifold 36 and through the lines 37 and 38 and into the respective tanks 14 and 16, as mentioned.

The aforesaid apparatus is supported on a cart 41 which has wheels 42 for supporting itself and the remainder of the apparatus in the mobile or portable arrangement as indicated in FIG. 1. Accordingly, the entire apparatus can be moved via the cart 41 and to the location where the mold 13 is, and the connections can then be made to the mold 13 for the application of the several cleaning fluids. In this description, the air supply as such is not shown, but it will be understood that there is an air supply, such as the usual supply of compressed air in an industrial plant, and that supply is directed to the apparatus connection 12 for applying the air through the pipe or line 26, as described. In that manner, there are three fluid supplies of acid, air, and water and they are applied in that sequence to the object 13 for cleaning the object.

The acid 10 is retained in its lines and tank 14 to be separated from the water 11 which is likewise retained separated from the tank 14, but the air supply can go into both tanks 14 and 16 and it will simply be released through a breather 44 on each tank 14 and 16.

FIG. 2 shows that each line 23, 24, and 26 has a fluid flow check valve 46 therein, and thus each fluid can flow from its respective supply and through its respective line 23, 24, and 26 and into its extension line designated 27 which is in fluid flow communication with the manifold 22. In that arrangement, the fluid flowing into the manifold 22 and from any one of the lines 23, 24, and 26 cannot flow into any one of the other two lines and can only go into the extension line 27 which is an inlet line for the manifold 22. In that manner, the three fluids remain separated in their entry into the manifold 22. FIG. 2 further shows that there are shutoff fluid-flow valves 48 for the water and 49 for the acid and 51 for the air, with all of those three valves controlling the flow from the respective supplies of the fluids and into the manifold inlet lines 27 and 28, as described.

Also, there is a motorized fluid flow control valve 50 and 52 fluid-flow control connected in each line 37 and 38 returning the respective fluid to the tanks 14 and 16. The operation and function of these motorized fluid flow control valves 50 and 52 are described hereinafter. FIG. 1 shows fluid filters 53 disposed within each tank for receiving the fluid flowing into the tanks and filtering same, and tank covers 54 are provided for access to the interior and the removal and cleaning of the filters 53.

A main and operator-controlled electric switch 56 is included in the electric circuit, and it is preferably key-operated so that only one operator can retain the key and operate same. Also, there are two electric pushbuttons 57 and 58, one for each of the two liquids, and there is an electric signal 59 and 60 for each respective circuit. Further, there is a timer 61 electrically connected in the circuit and for each of the liquid lines for timing the length of time that each respective pump 17 and 18 is operating. A front panel board 62 is provided.

A quick connection 63 is available for the air supply and for connection to the air inlet connector 12, in a conventional manner. Disclosure document No. 320,435 filed Nov. 18, 1992 shows the apparatus and is incorporated herein, entitled MOLD COOLING PASSAGEWAY CLEANING APPARATUS.

Figure 3:
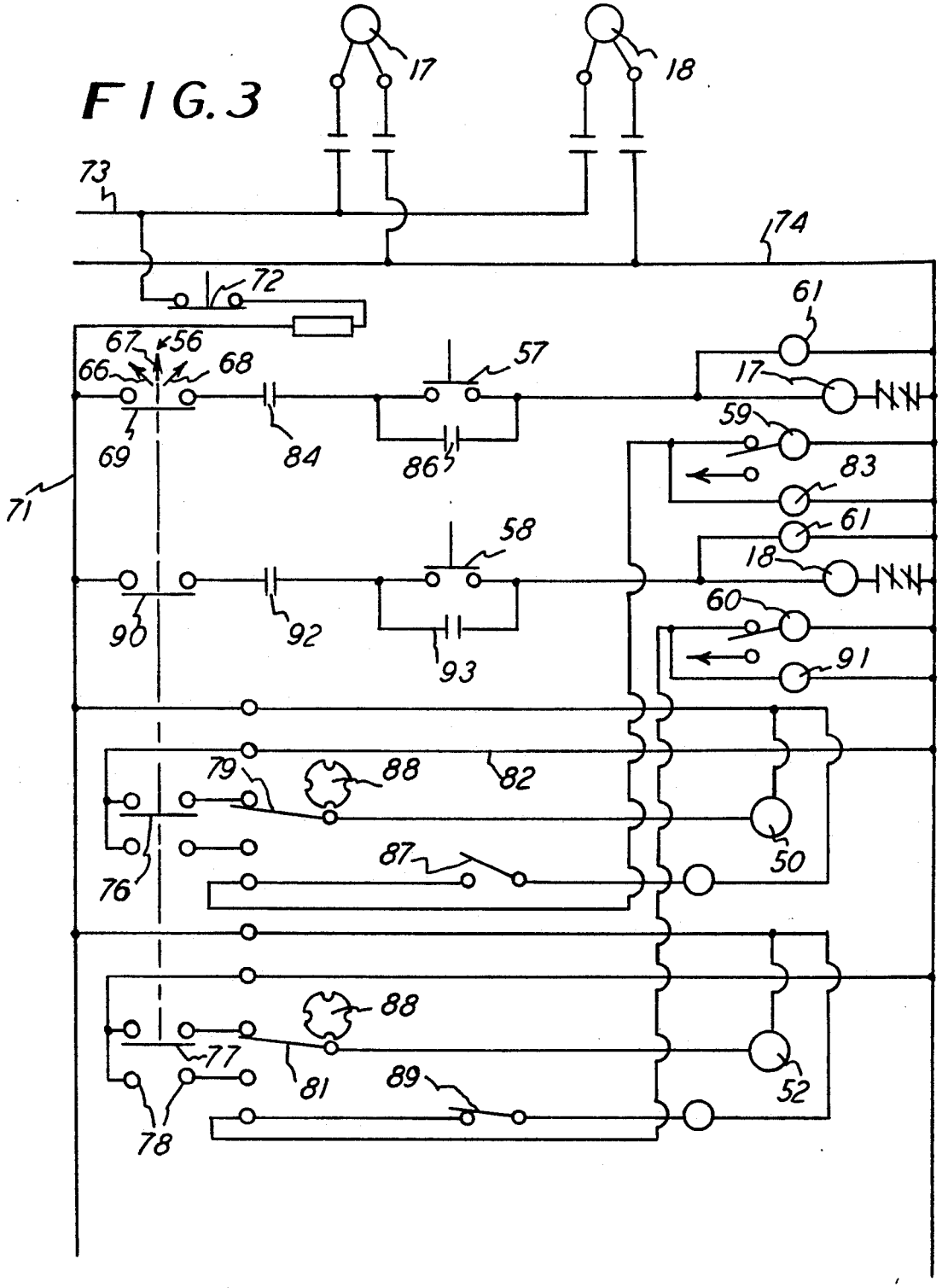
FIG. 3 is an electric schematic of the apparatus of this invention.

For instance, with the switch 56 set in the acid-setting position 66, the electric connection at 69 is completed, and thus there is connection to the main power line 71 which is connected through an emergency switch 72 to the incoming power line 73. It will also be seen and understood that the incoming power line 74 has other extents and connections as shown on the right-hand side in FIG. 3.

In that acid-setting position 66, the electric connection at 76 is also completed, and the electric connection at 77 is completed with the two contacts 78. That is, the connecting bars at 69 and 76 are upward against the contacts, and the connecting bar 77 is downward against the contact 78. There is an electric switch 79 built into the electrically powered valve unit 50 and there is an electric switch 81 built into the electric powered valve unit 52. This arrangement presents the valve 50 in the open or fluid passage condition, and it presents the valve 52 in the closed or the fluid blockage position. Also, through line 82, the valve motor 50 is connected to the acid pump 17 which in turn is connected in the line with the pushbutton switch 57 and by virtue of the electric relay 83 showing its contacts 84 adjacent the switch 57. A holding relay 86 is in parallel with the switch 57 such when the switch 57 is closed, then the relay 86 is effective for holding the circuit in the closed position even though the pushbutton 57 is released. With this arrangement, the acid pump 17 is electrically energized while the acid valve 50 is open. Before the operator actuated the switch 57, the signal 59 was energized to indicate to the operator that the switch 57 could be closed because the valve 50 was in the open position for the flow of the acid. Another switch 87 is shown in the circuit and connected with the light signal 59 to go to the closed position when the aforementioned sequence is performed and thus signal the operator that switch 57 can be closed.

In the description given heretofore the electric schematic and circuitry, to this stage, is such that when the acid motorized valve 50 is in the open position for the passage of acid into the tank 14, then the acid pump 17 can be energized. At the same time, the wire-motorized valve 52 has moved to the closed position so that the acid flowing in the manifold 36 cannot enter the water line 58 and its water tank 16, and at the same time the water pump 18 cannot be energized. That is, the electric circuitry utilized herein is foolproof and sequentially effective for the three fluids described and it is mutually exclusive with regard to opening and closing the respective two liquid lines. Additionally, with regard to the air line, the air can move through the line when the switches are in the position described with respect to the movement of the acid, and that of course is when the switch 56 has been shifted to the position 67 and that shifting does not alter the positioning of the various electric contacts previously described.

Also, it will be seen and understood that the motorized valves 50 and 52 contain a cam which controls the electric contacts so that the valves will remain in one electrically established position, thus open or closed, until a 90 degree shifting has occurred, and thus the valves will alternately open and close under the camming effect of the cams 88 which are conventional types of controls for the motorized valves 50 and 52.

When the switch 56 is shifted to position 68, then the electric bar 69 is open and the electric bar 90 closes upwardly and the electric bar 76 and 77 close downwardly. The switch 79 is in the closed position so that the motor valve 50 shifts to its closed position at which time the switch 87 opens and breaks the acid electric circuit while the water electric circuit is closed and the water valve 52 has shifted to the open position and its electric switch 89 is closed so that the water circuit is then complete and the signal 60 is energized and the operator can then close the switch 58 to close the water line relay 91 and its contacts 92 and thus energize the water pump 18 which is held closed by the holding relay 93.

In summary, the electric circuit is arranged such that when one motorized valve 50 or 52 is in the open position, the other is in the closed position, and there are the various switches connected therewith, as shown in the schematic and these are conventional arrangements for the motorized valves 50 and 52. The liquid lines are thus opened and closed and operated in reverse to each other so that only one line at a time has fluid flowing therethrough, and neither pump 17 or 18 can be electrically energized until its respective motorized valves 50 and 52 are in the appropriate closed position. Also, if either signal light 59 or 60 is not illuminated, that means that its respective circuit is not closed and ready for the operation of its respective operator control switch 57 or 58.

The combined motor and ball valve 50 and 52 are conventional units and are manufactured by BLDL Incorporated of 430 Route 46, Totowa, N.J. 07512. The switches and contacts 76–79, cams 88, and switches 87 and 90 are included in that commercial unit.

What is claimed is:

1. An apparatus for dispensing cleaning fluids to an object, at least two cleaning fluid supplies for said apparatus, a fluid-flow inlet line in respective fluid-flow communication with each of said supplies and being connectable to said object for the inlet flow of said fluids into said object, a fluid-flow outlet line in respective fluid-flow communication with each of said supplies and being connectable to said object for the outlet flow of said fluids from said object, a fluid-flow control valve respectively disposed in at least two of said outlet lines for controlling the flow of said fluids from said object and to said supplies and with said control valves being arranged to operationally open and close relative to fluid flow, the improvement comprising electrically powered means operatively associated with said control valve and being in at least said two of said outlet lines for operationally opening and closing said control valves in operational directions opposite to each other for the respective flow and blockage of the flow of fluids relative to said supplies, a fluid-flow one-way check valve respectively disposed in each of said inlet lines for blocking the flow of fluid in said inlet lines in the direction opposite said inlet flow into said object and thereby block the flow of fluid from said inlet lines and to said supplies before the fluid flows past said object, and an electric circuit, a fluid-flow electric pump electrically connected in said circuit and being in fluid flow communication with each of said supplies for respectively sequentially moving the fluids from said supplies through said inlet lines and said object and said outlet lines, for circulating said supplies through said apparatus in the sequence mentioned.

2. The apparatus for dispensing cleaning fluids to an object as claimed in claim 1, wherein each of said inlet lines includes a respective first length and an extension length common to and for all of said first lengths and being in fluid-flow communication with said first lengths and said object, and said check valves being disposed in said first lengths of said inlet lines for preventing the flow of the fluids from one of said first lengths and through another of said first lengths.

3. The apparatus for dispensing cleaning fluids to an object as claimed in claim 2, wherein each of said supplies is respectively from one of the group of an acid, water, and air.

4. The apparatus for dispensing cleaning fluids to an object as claimed in claim 1, wherein each of said supplies is respectively from one of the group of an acid, water, and air.

5. The apparatus for dispensing cleaning fluids to an object as claimed in claim 1, including an electric switch electrically connected in said circuit and being electrically connected with each of said pumps, said switch being arranged to mutually exclusively electrically connect with each of said pumps for the electric energizing of said pumps only one at a time.

6. The apparatus for dispensing cleaning fluids to an object as claimed in claim 5, including an electric relay electrically connected in said circuit and being electrically interconnected with said electric switch and said powered means and being arranged to alternately complete and discontinue the electric energizing of said pumps in accord with the opened and closed positions of said control valves.

7. The apparatus for dispensing cleaning fluids to an object as claimed in claim 6, wherein said electric powered means is included in said electric circuit and includes an electrically operative motor respectively operatively associated with each of said fluid-flow control valves for the operational flow-directional setting of said fluid-flow control valves.

8. The apparatus for dispensing cleaning fluids to an object as claimed in claim 6, including an additional electric switch electrically connected in said circuit and with each of the first-mentioned said electric switch for controlling the electric connection within said circuit and thereby control the electric powering of said pumps.

9. The apparatus for dispensing cleaning fluids to an object as claimed in claim 1, wherein each said electrically powered means is electrically connected in said circuit and includes an electric motor and an electric relay, each said relay being electrically operatively associated with a respective one of said control valves to be electrically closed in accord with the operational position of the respective said control valve, and including an electric switch respectively electrically connected in said circuit and with each said relay for electrically closing for the electric energizing of said powered means and thereby control the operational positions of said control valves.

10. An apparatus for applying cleaning fluids to an object, a tank for containing an acid and a tank for containing water, a manifold, two manifold inlet fluid-flow lines in separate fluid-flow communication with each of said tanks and said manifold, a manifold outlet fluid-flow line in fluid-flow communication with said manifold and for fluid-flow connecting to said object, two tank inlet fluid-flow lines in separate fluid-flow communication with each of said tanks and for connecting to said object, a fluid-flow control valve in each of said two tank inlet lines for controlling the flow of fluid therethrough, a fluid pump in fluid-flow communication with each of said tanks for pumping fluid therefrom, the improvement comprising an electric circuit including an electric control operatively associated with each said control valve for opening and closing said control valves simultaneously in operationally open and closed positions opposite to each other, and said circuit includes an electric connection electrically connected to each of said pumps for electrically powering said pumps, an electric switch included in each of said electric connections for selective control of electric energy to each of said pumps, and the said circuit includes an electric relay electrically connected in each said electric control and is operatively associated with each said control valve and each said switch for the electric energizing of each said pump in accordance with opened and closed positions of said control valves, and electric switching means electrically operatively associated with said electric controls for the opening and closing of said control valves, and being electrically connected in said circuit.

11. The apparatus for dispensing cleaning fluids to an object as claimed in claim 10, wherein said circuit includes an electric signal electrically connected with each said relay for signaling when each said relay is electrically closed and thereby complete the electric circuit between said pump electric connections and said electric switches.

12. The apparatus for dispensing cleaning fluids to an object as claimed in claim 10, including an additional electric switch electrically connected in said circuit and with each of the first-mentioned said electric switch for controlling the electric connection within said circuit and thereby control the electric powering of said pumps.

13. The apparatus for dispensing cleaning fluids to an object as claimed in claim 10, wherein each of said supplies is respectively from one of the group of an acid, water, and air.

14. The apparatus for dispensing cleaning fluids to an object as claimed in claim 10, including a fluid-flow one-way check valve respectively disposed in each of said manifold inlet lines for blocking the flow of fluid in said manifold inlet lines in the direction opposite said inlet flow into said object and thereby block the flow of fluid from said manifold inlet lines and to said supplies before the fluid flows past said object.

15. The apparatus for dispensing cleaning fluids to an object as claimed in claim 10, including a floor-mobile support, said apparatus being mobily supported on said support for transport to the locale of said object to be fluid-flow connected therewith.

16. The apparatus for dispensing cleaning fluids to an object as claimed in claim 10, including an air supply line connected to both said inlet fluid-flow lines for directing compressed air into said manifold, said pumps being electrically operative, and said switching means being electrically associated with said pumps and having electric contacts in sequence for the sequential electric energizing of said pumps in coordination with the sequencing of said switching means for first supplying acid to said object and then secondly supplying air to said object and then lastly supplying water to said object.

17. The apparatus for dispensing cleaning fluids to an object as claimed in claim 10, including a fluid filter in each of said tanks at the location of said inlet lines thereto, for filtering the fluid flowing into said tanks.

* * * * *